United States Patent [19]

Germann

[11] Patent Number: 4,633,777

[45] Date of Patent: Jan. 6, 1987

[54] MULTICOLOR ROTARY PRINTING MACHINE

[75] Inventor: Albrecht J. Germann, Würzburg, Fed. Rep. of Germany

[73] Assignee: De La Rue Giori S.A., Lusanne, Switzerland

[21] Appl. No.: 829,463

[22] Filed: Feb. 12, 1986

Related U.S. Application Data

[63] Continuation of Ser. No. 620,315, Jun. 13, 1984, abandoned.

[30] Foreign Application Priority Data

Jul. 26, 1983 [CH] Switzerland ..... 4083/83

[51] Int. Cl.[4] ..... B41F 5/16; B41F 5/22

[52] U.S. Cl. ..... 101/177; 101/179; 101/182

[58] Field of Search ..... 101/177, 178, 179, 180, 101/181, 182, 183, 184, 185, 217, 220, 221, 137, 138, 139, 140, 142, 143, 144, 145

[56] References Cited

FOREIGN PATENT DOCUMENTS

| | | | |
|---|---|---|---|
| EP92887 | 11/1983 | European Pat. Off. | 101/177 |
| 2094715 | 9/1982 | United Kingdom | 101/177 |
| 2094717 | 9/1982 | United Kingdom | 101/177 |
| 2095622 | 10/1982 | United Kingdom | 101/177 |

*Primary Examiner*—J. Reed Fisher

*Attorney, Agent, or Firm*—Kane, Dalsimer, Kane, Sullivan and Kurucz

[57] ABSTRACT

The machine can print on both sides of the paper either an image with juxtaposed colors by means of a typographic plate inked respectively by an ink collecting cylinder inked in turn by selective color inking cylinders of which the number corresponds to the number of colors, or an image with superposed colors and designs by means of plate cylinders substituted for the selective color inking cylinders and provided with printing plates inking a respective offset cylinder and of which the number corresponds to the number of colors and designs, or an image of each type aforesaid. For this purpose the machine comprises two blanket cylinders operating either as collecting cylinders spaced from each other, each in contact with a cylinder carrying said typographic plate of which the image is transferred via another blanket cylinder to the paper surface, or as offset cylinders pressed against, and printing, the paper, or one as a collecting cylinder and the other as an offset cylinder, both separated. In the last case the image on the offset cylinder is transferred via a transfer cylinder substituted for the cylinder carrying the typographic plate to said blanket cylinder.

3 Claims, 8 Drawing Figures

MULTICOLOR ROTARY PRINTING MACHINE

This is a continuation of co-pending application Ser. No. 620,315 filed on June 13, 1984, now abandoned.

FIELD OF INVENTION

The invention relates to a multicolor rotary press for simultaneously printing both sides of a web or sheet, notably for printing the safety background of fiduciary notes, more particularly bank notes, this machine comprising a first pair of blanket cylinders having each disposed along its outer periphery a group of several cylinders each inked by an inking device with a different color, said inked cylinders cooperating with the corresponding blanket cylinder of said first pair for forming a multicolor image thereon, and comprising a second pair of blanket cylinders cooperating each with a roller adapted to engage one or the other of said blanket cylinders of said first pair.

PRIOR ART

In a German patent application now published (No. DE-A-31 09 964) a machine of this character has already been described which is capable of printing on both sides of the paper an image with juxtaposed colors. Each image is printed by means of a single typographic printing plate representing the complete design to be printed, this plate being mounted on one of said rollers. this typographic plate is inked by a collector cylinder consisting of one of said blanket cylinders of the first pair, which is inked in turn by a plurality of selective color inking cylinders formed by said group of cylinders and of which the number corresponds to the number of colors of an image to be printed. Each selector cylinder comprises specific relief cut areas representing the portions to be colored with a predetermined color transferred thereto by its inherent inking device. This machine is intended notably for printing the safety background of bank notes.

For obtaining the simultaneous printing, the paper passes between the two blanket cylinders of the second pair which are pressed against each other and transfer the image from one or the other typographic inked plate to one or the other side of the paper.

With this method, commonly referred to as the "Orlof" method, a multicolor image is obtained which warrants a perfect registration between the different colors of the image design, a result that cannot be achieved with any other printing process.

Since the selective color inking cylinders engage a resilient surface of the collector cylinder, they can be made from hard material whereby very fine relief areas, therefore very fine colored areas, for instance in the form of lines or points, can be cut.

On the other hand, the indirect or offset typographic printing method with superposed colors and designs is also known, which is also used for printing safety background. In this method, the complete design consists of partial drawings of different colors carried by printing plates mounted on plate cylinders so that the drawings and colors can be superposed in proper registration with each other on a blanket cylinder against which the paper to be printed is pressed. The number of printing plates and consequently of plate cylinders corresponds to the number of different colors and designs constituting the multicolor image. Machines of this type are also available for the simultaneous printing of both sides of the paper, wherein the paper is caused to pass between two blanket cylinders, each blanket cylinder receiving a multicolor image of the corresponding plate cylinders.

In the present state of the art, machines have been developed which operate according to one or the other of the above-described methods.

It is the object of this invention to provide a same and single machine for simultaneously printing both sides of the paper with the possibility of operating according to the two above-described methods, which will be referred to hereinbelow as the "Orlof" method and the offset method, and both methods at the same time, for making an "Orlof" print on one side and an offset print on the other side of the paper, the switching from one method to the other method taking place in the simplest possible manner.

SUMMARY OF THE INVENTION

This object is attained by a machine disclosed in claim 1.

The advantage offered by this machine is not only of technical order since it permits of operating according to two completely different methods, and also according to both methods at the same time, but also of economical order since the user can choose the proper method without resorting to three separate machines. The steps necessary for changing from one method to the other method with this machine are extremely simple.

An advantageous form of embodiment for sheet-by-sheet printing is disclosed in the subordinate claim.

The invention will now be described by way of non-limiting example through two forms of embodiment with reference to the attached drawings.

BRIEF DESCRIPTION OF THE DRAWINGS

The Figures differ only with respect to the relative arrangement of certain component elements, therefore the same elements are designated by the same reference numerals throughout the Figures of the drawings.

DESCRIPTION OF THE PREFERRED EMBODIMENTS

Figure 1:
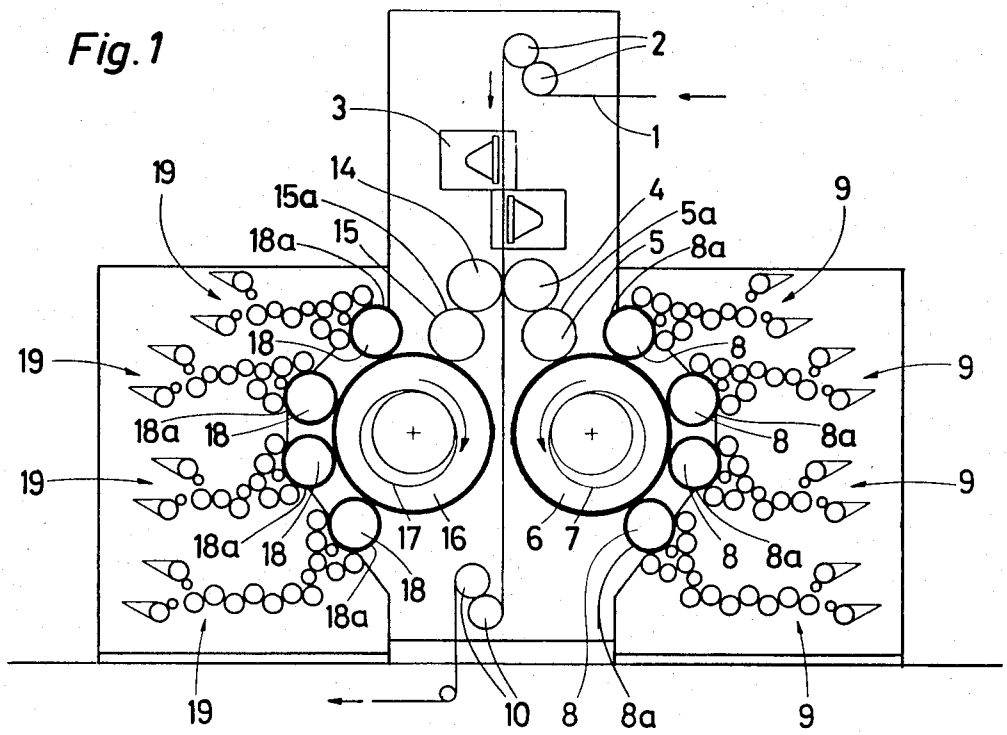
FIG. 1 illustrates diagrammatically for a web-fed pringing machine the position of all the members when it operates according to the "Orlof"-"Orlof" method.
Figure 2:
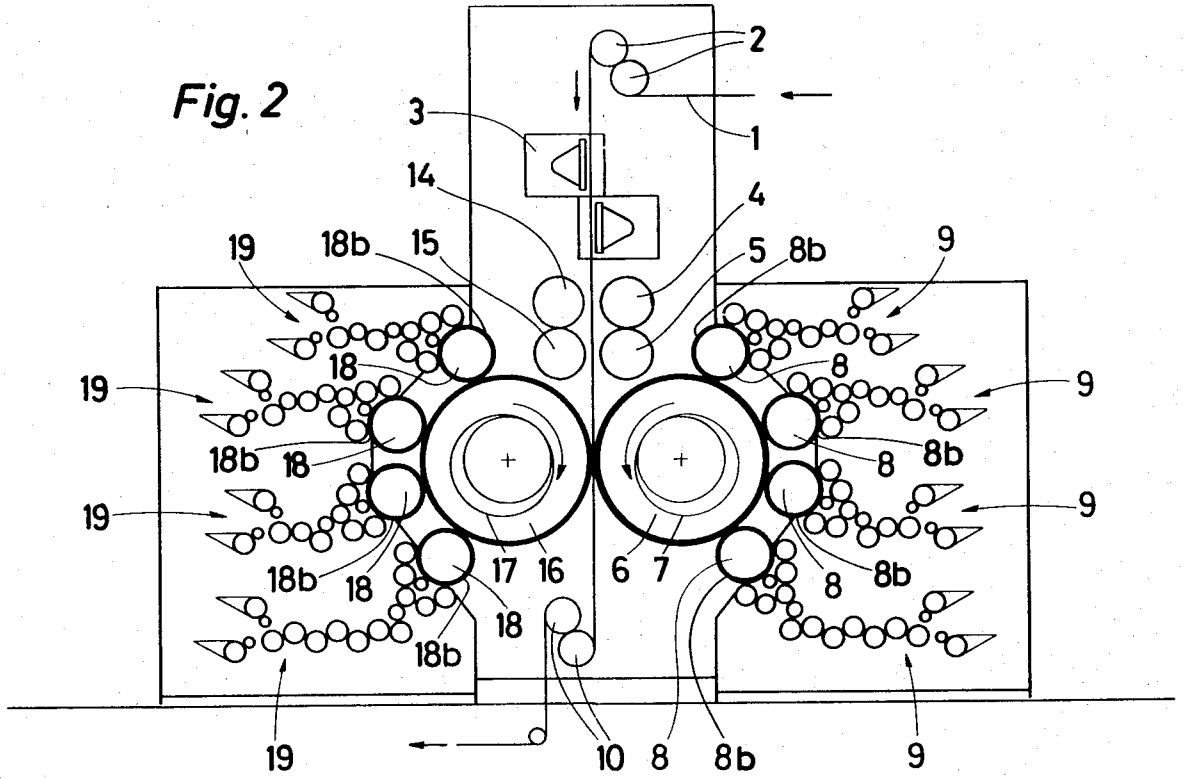
FIG. 2 illustrates diagrammatically the same machine arranged for the offset-offset method.

The machine illustrated in FIGS. 1–4 is a web-fed printing machine comprising input rollers 2 for the paper web 1 and a dedusting device and static electricity eliminator 3 for the paper web 1. The paper web 1 may be printed either between the two blanket cylinders 4,14 according to the "Orlof"-"Orlof" method (FIG. 1), according to the offset-"Orlof" method (FIG. 3) or according to the "Orlof"-offset method (FIG. 4), or still between the two large blanket cylinders 6,16, according to the offset-offset method (FIG. 2). After having been printed, the paper is fed by the output rollers 10 to the outside of the machine. The cylinders rotate in the directions show by the arrows.

For printing according to the "Orlof"-"Orlof" method, the two blanket cylinders 6,16 are moved away from each other (FIG. 1) while the blanket cylinders 4, 14 are subjected to pressure. In practice, this separation is obtained very simply, as illustrated for cylinders 6,16, by means of an eccentric 7,17 on which the body of each blanket cylinder 6,16 is mounted. This eccentric mounting is well known for adjusting the pressure and separating, two cylinders when the machine is inoperative, the mounting being such that when the eccentric is rotated the cylinder is moved. Therefore, for this separation, the invention utilizes means already known in existing machines. When the two cylinders are spaced from each other, the distance between them is very small, only one or a few millimeters, the distance illustrated in FIG. 1 being strongly exaggerated.

Since the machine comprises two symmetrical halves, only one half, i.e. the right-hand half, will be described in detail hereunder.

In the example illustrated in FIG. 1 the blanket cylinder 6 cooperates with four selective color inking cylinders 8 having relief areas 8*a* cut in accordance with the contour of the areas to be printed in the selected color and which are each inked in this color by means of an inking unit with double ink duct 9. These selective color inking cylinders 8 with said relief portions 8*a* are also made preferably from a hard material not likely to undergo a distortion even if the relief is very fine, thus permitting of obtaining a safety background made of very fine lines. The four-color areas are transferred to the blanket cylinder 6 acting as a collecting cylinder on which these colors are assembled and through which these colors are transferred to a single plate cylinder 5 carrying a typographic printing plate 5*a* contacting said collecting cylinder; this plate 5*a* represents the complete design to be printed in four colors. The complete image printed in the various colors is transferred in turn to blanket cylinder 4 of smaller diameter than blanket cylinder 6, which cooperates with the blanket cylinder 14 of the other half of the machine for applying the impression of the complete image on the corresponding side of the paper.

Simultaneously another image is printed on the other side of the paper by this blanket cylinder 14. This other image is created in a similar manner by the corresponding component elements of the other half of the machine, namely the four cylinders 18 comprising relief areas 18*a* inked by the four inking units 19, the collecting cylinder consisting of the other blanket cylinder 16 and the plate cylinder 15 engaging this blank cylinder 16 and provided with the typographic plate 15*a* representing the complete design of said other image transferred to the blanket cylinder 14. During the simultaneous printing the two blanket cylinders 4 and 14 act mutually as counter-pressure cylinders.

When the same machine is used for printing according to the offset-offset method (FIG. 2), it is only necessary to substitute plate cylinders 8,8*b* and 18, 18*b* for the selective color inking cylinders 8,8*a* and 18,18*a*, these plate cylinders 8,8*b* and 18,18*b* being provided with printing plates 8*b* and 18*b*, to separate the two blanket cylinders 4,14 from each other and also the plate cylinders 5 and 15 of blanket cylinder 6, respectively 16, and to set these two blanket cylinders 6,16 under pressure so that they can print the paper 1. Under these conditions cylinders 4,5,14 and 15 are inoperative and therefore not driven, since their driving means being disconnected from the machine driving system.

Printing plates 8*b* and 18*b* are offset plates, notably typographic plates like those used in the dry offset process, and represent partial image inked as in the preceding case by inking units with double ink duct 9,19. These partial images of different colors are assembled on blanket cylinders 6 and 16 respectively which in this case operates as offset blanket cylinder, therefore as collecting cylinders for the partial images constituting the final multicolor image. Thus, a simultaneous, four-color dry-offset printing is obtained on each side during the passage of the paper between the two blanket cylinders 6,16.

The adjustment of the distances between the various cylinders, namely between blanket cylinders 4 and 14, as well as between blanket cylinders 6 and 16 and between plate cylinder 5 or 15 and blanket cylinder 6 or 16, and also the necessary translations of the other rollers and cylinders in relation with the displaced cylinders, are obtained in a manner known per se, notably by mounting all the rollers and cylinders on eccentrics as already mentioned hereinabove with reference to blanket cylinders 6 and 16. The gaps formed between the cylinders are extremely small, of the order of a few millimeters. In general the inking units 9 and 19 are mounted on movable carriages.

Figure 3:
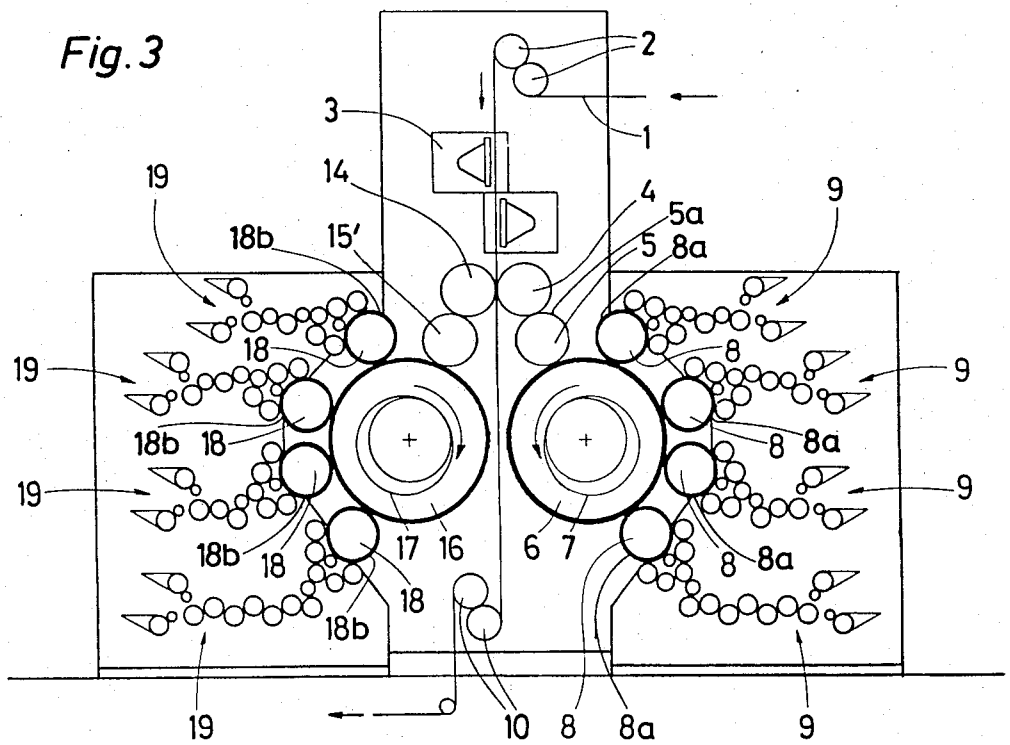
FIG. 3 illustrates diagrammatically the same machine when it operates according to the offset-"Orlof" method.
Figure 4:
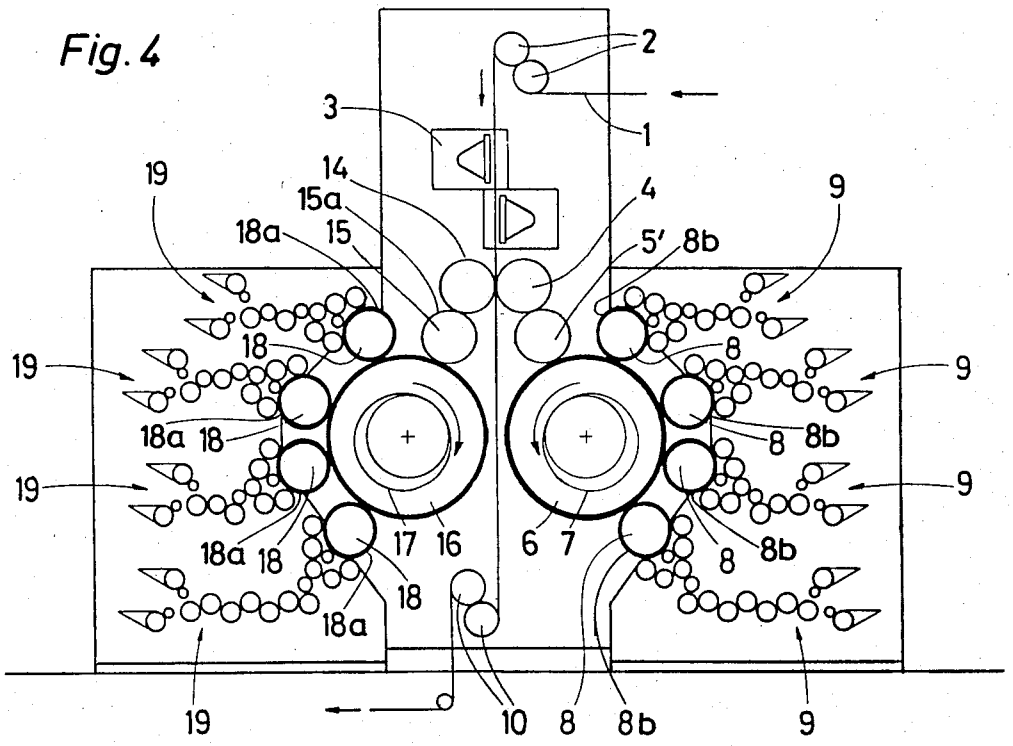
FIG. 4 illustrates diagrammatically the same machine when it operates according to the "Orlof"-offset method, the machine halves being exchanged with respect to FIG. 3.

With this machine it is also possible to print according to the offset-"Orlof" method, as illustrated in FIG. 3. In this case, the positions of the component elements corresponds to the "Orlof"-"Orlof" method as shown in FIG. 1.

In the present example, the right-hand side of the machine produces the "Orlof" print by means of the selective color inking cylinders 8,8*a* and plate cylinder 5 provided with a typographic plate 5*a* inked by blanket cylinder 6 operating as a collecting cylinder inked in turn by the selective color inking cylinders 8,8*a*.

The left-hand side of the machine makes the offset printing by means of the plate cylinders 18 provided with offset plates 18*b* inking the blanket cylinder 16. In this case, the image is transferred from this blanket cylinder 16 by means of an image transfer cylinder 15' to blanket cylinder 14; in this mode of operation said image transfer cylinder 15' is substituted for plate cylinder 15 (FIG. 1) and consists of a rubber or blanket cylinder. In this case concerning a mixed simultaneous printing the offset image is printed on the paper by the blanket cylinder 14 after having been transferred via cylinder 15'.

In a fourth mode of operation (FIG. 4), the two halves of the machine are exchanged thus permitting an "Orlof"-offset impression. It is the left-hand side that prints the "Orlof" image by means of the selective color inking cylinders 18,18*a* and the plate cylinder 15 carrying the typographic plate 15*a*, and the right-hand side that prints the offset image by means of the offset plate cylinders 8,8*b* and the image transfer cylinder 5' substituted for plate cylinder 5.

This possibility of choosing the side in the case of simultaneous printing is essential if the paper printed in the above-described machine must subsequently pass through another printing unit so that at least one paper side receives a second printing, for example a copper-plate engraving printing, as the main image.

FIGS. 5 to 8 show different arrangements of a sheet-by-sheet printing machine for making a simultaneous "Orlof"-"Orlof" (FIG. 5), offset-offset (FIG. 6), offset-"Orlof" (FIG. 7) and "Orlof"-offset (FIG. 8) printing. This machine and its four different arrangements are substantially identical with the web printing machine as shown in FIGS. 1,2,3, and 4, except for the means for transferring the sheets 21. The path followed by these sheets 21 is shown in thick line in FIGS. 5–8. The sheets 21 to be printed are fed in a known fashion by a stop drum 22 and two transfer drums 23 provided with grippers. In contrast with the case of paper web 1, the sheets 21 in each processing mode constantly contact one of the blanket cylinders of pair 4,14 and one of the blanket cylinders of pair 6,16, in the example concerned with blanket cylinders 4 and 6 also operating constantly as transfer drums and provided with grippers. To ensure the transfer of the sheets from cylinder 4 to cylinder 6, there is provided an intermediate transfer drum 24 provided with grippers which cooperates permanently with the two blanket cylinders 4 and 6. After being printed, the sheets 21 are transferred by a chain gripper system 25 to an output stack or to a machine for completing the printing, for example by a copper-plate engraving printing.

During the "Orlof"-"Orlof" process (FIG. 5) the arrangement corresponds to that shown in FIG. 1. Both blanket cylinders 6 and 16 are separated from each other and operate as collecting cylinders inked by the selective color inking cylinders 8,8*a* and 18,18*a*, and ink in turn the typographic plate 5*a*, respectively 15*a* on plate cylinder 5, respectively 15. The inking units 9 and 19 are shown only diagrammatically in the form of a few rollers and comprising for example the same component elements as those shown in FIGS. 1–4. The blanket cylinders 4 and 14 are pressed against each other and print the corresponding image on one and the other side of sheets 21.

In the example illustrated the ratio of the diameters of cylinders 4,5,8,14,15,18 and 24 to the diameters of cylinders 6 and 16 is 1:3. Therefore, each periphery of cylinders 6 and 16 corresponds to three sheets of paper, and these blanket cylinders 6 and 16 carry each three blankets whereas cylinders 4 and 14 carry only one blanket each.

The fact that sheets 21 remain in contact with the area of blanket cylinder 6 which still carries the ink which has not been transferred to plate cylinder 5 has no detrimental consequence, for the arrangement is such that the inked areas of cylinder 6, when they engage a sheet 21 carrying the image printed by cylinder 4, register with the colored areas of the printed image.

To meet this registration requirement, the cylinders involved must be arranged as follows : the sum of the length of the arc formed on the periphery of cylinder 5, as seen in the direction of rotation of the cylinders, between the point of contact thereof with cylinder 6 and cylinder 4, plus the length of the arc on the periphery of cylinder 4 between the point of contact thereof with cylinder 5 and the input point of the paper on cylinder 4, plus the length of the paper trajectory between the point where the paper engages cylinder 4 and its point of arrival on cylinder 6, must be equal to the length of the arc on the periphery of cylinder 5 (which is equal to $\frac{1}{3}$ of the periphery of this cylinder 6). Under these conditions, one point of the image transferred to the paper by cylinder 4 from one of the three blankets carried by cylinder 6 is coincident, when the paper engages cylinder 6, with the same location of the image of the next blanket. The arrangement of the cylinders concerned for obtaining this registration is know in the art (No. DE-A,3,109,964).

Moreover, since the sheets 21 do not undergo any pressure on cylinder 6, the possible transfer of ink from cylinder 6 to the sheets is very moderate.

For carrying out the offset-offset method (FIG. 6) the arrangement corresponds to the one illustrated in FIG. 2. Both blanket cylinders 6 and 16 are pressed against each other and inked by offset plates 8*b* and 18*b* mounted on plate cylinders 8,8*b* and 18,18*b*. Blanket cylinders 4 and 14 are separated from each other, plate cylinder 5 is separated from blanket cylinders 4 and 6 and plate cylinder 15 is separated from blanket cylinder 16. Both blanket cylinders 5 and 15, as well as blanket cylinder 14 are thus inoperative, while the other blanket cylinder 4 acts as a transfer cylinder for the sheets transferred via transfer drum 24 to blanket cylinder 6 for printing by means of cylinders 6 and 16.

Figure 5:
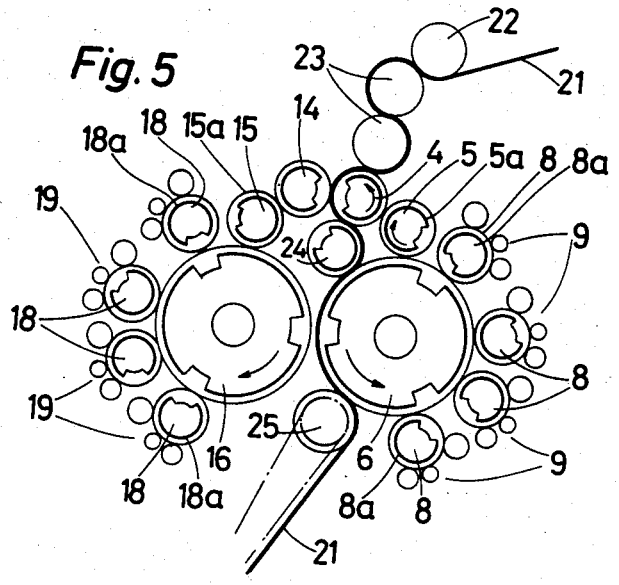
FIG. 5 illustrates in the case of a sheet printing machine the position of all the component elements when it operates according to the "Orlof"-"Orlof" method.
Figure 6:
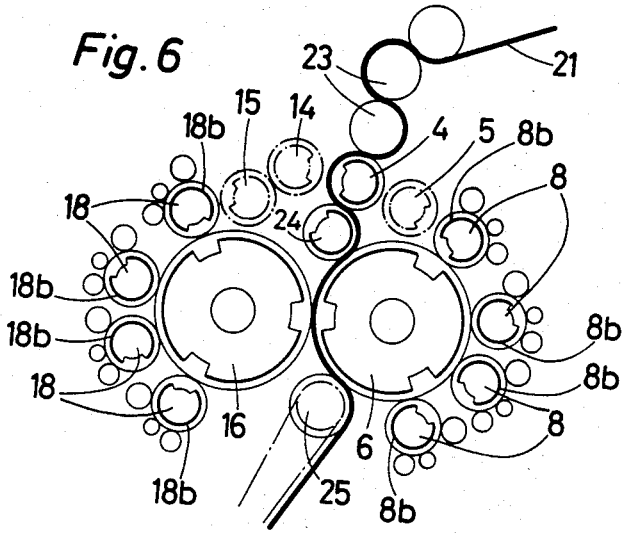
FIG. 6 illustrates diagrammatically the same machine arranged for the offset-offset method.
Figure 7:
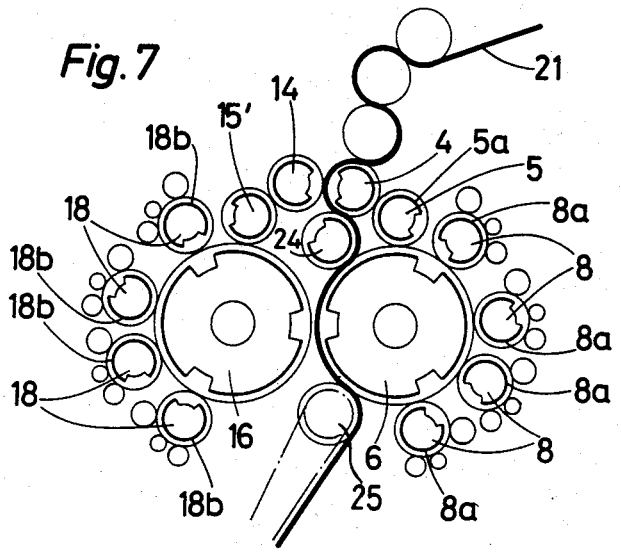
FIG. 7 illustrates diagrammatically the same machine when it operates according to the offset-"Orlof" method.
Figure 8:
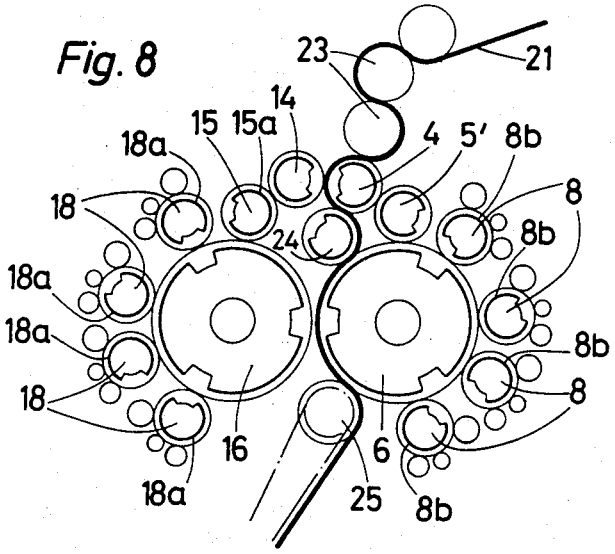
FIG. 8 illustrates diagrammatically the same machine when it operates according to the "Orlof"-offset method, the two halves of the machine being exchanged in relation to FIG. 7.

To carry out the mixed offset-"Orlof" process (FIG. 7), the arrangement of the component elements corresponds to that shown in FIG. 5.

In the example considered herein, the right-hand side of the machine produces the "Orlof" printing by means of selective color inking cylinders 8,8*a* and plate cylinder 5 carrying a typographic plate 5*a* inked by blanket cylinder 6 acting as an ink collecting cylinder inked in turn by selective color inking cylinders 8,8*a*.

The left-hand side of the machine produces the offset printing by means of plate cylinders 18 provided with offset plates 18*b* inking the blanket cylinder 16. In this case, the image is transferred from this blanket cylinder 16 by means of an image transfer cylinder 15' to blanket cylinder 14; said image transfer cylinder 15' is substituted in this mode of operation for plate cylinder 15 (Figure 5) and consists of a rubber or blanket cylinder. In this case of a simultaneous mixed impression the offset image is thus printed on the paper by blanket cylinder 14 after having been transferred via cylinder 15'. Regarding the contact between sheets 21 and blanket cylinder 6 transmitting said sheets to the chain gripper system 25, the same remarks as experessed in connection with FIG. 5 are applicable.

In a fourth mode of operation (FIG. 8) permitting an "Orlof"-offset printing, the two halves of the machine are exchanged and it is the left-hand side that prints the "Orlof" image by means of selective color inking cylinders 18,18*a*; the image transfer cylinder 15' being replaced by a plate cylinder 15 provided with a typographic plate 15*a* representing the complete design, and it is the right-hand side that prints the offset image by means of offset plate cylinders 8,8*b*, the plate cylinder 5 of the preceding example being replaced by an image transfer cylinder 5'.

In all the example described hereinabove the selective color inking cylinders 8,8*a* and 18,18*a* intended for inking blanket cylinders 6,16 having a collective function may be replaced by sectioned plates acting as color selecting plates fixed to a cylinder. Thus, in this case, when it is desired to convert from one printing method to another it is only necessary to change the plates on cylinders 8,18 contacting the corresponding blanket cylinders, without changing the bodies of the cylinders concerned. Similarly, the body of plate cylinder 5 or 15 may remain mounted during the conversion of one of these cylinders into an image transfer cylinder 5' or 15' if the typographic plate is thin enough and can be simply replaced by a blanket, and vice-versa.

Should the case arise, at least one of the printing units comprising a plate cylinder 8 and/or 18 and an inking device 9 and/or 19 on one and/or the other side of the machine may also be a wet offset unit, the corresponding plate cylinder or cylinders being provided with a wet offset plate.

On the other hand, in the machine described for web printing the direction of travel of the paper and the direction of rotation of the cylinders may be inverted without any inconvenience, and in this case the paper will travel upwards and it is only the dedusting device and the static electricity eliminator that must be installed at the machine input, that is, at the bottom.

What is claimed is:

1. Rotary machine for the simultaneous multicolor printing of both sides of a web or sheet, more particularly for printing the safety background of fiduciary papers and notably bank notes, which comprises a first pair of blanket cylinders each blanket cylinder having arranged along the periphery a group of several cylinders each inked by an inking unit in a different color and cooperating with the corresponding blanket cylinder of said first pair for applying thereto a multicolor image, and comprising a second pair of blanket cylinders each adapted to cooperate with a roller arranged for engagement with one or the other of said blanket cylinders of said first pair wherein the path of the paper to be printed passes between the two blanket cylinders of said first pair, and comprising means for mounting the first pair of blanket cylinders for movement away from each other, means for mounting the blanket cylinders of said second pair of blanket cylinders for movement away from one another, and means for mounting the second pair of blanket cylinders and said rollers for movement away from the first pair of blanket cylinders; and comprising means for converting said several cylinders from selective color inking cylinders to plate cylinders and from plate cylinders to selective color inking cylinders, and means for converting said rollers from printing plate cylinders to image transfer cylinders and from image transfer cylinders to printing plate cylinders; means for selectively adapting said machine, to make different types of printings through the following arrangement of addition and replaceable component elements:

(a) means for selectively adapting said cylinders of each group into selective color inking cylinders of which the relief areas correspond to the image portions to be colored in the different colors and of which the number corresponds to the number of colors to be printed;

means for spacing the two blanket cylinders of said first pair from each other to operate as color collecting cylinders;

means for adapting said rollers into printing plate cylinders each provided with a typographic plate representing the complete design to be printed and set in contact with the corresponding collecting cylinder so as to be inked thereby;

means for pressing blanket cylinders of said second pair against each other so that a juxtaposed color image is printed on each side of the paper by means of the corresponding typographic plate inked by the relevant collecting cylinder;

(b) means for selectively adapting said cylinders of each group into plate cylinders each provided with a printing plate, the number of said printing plates in each group corresponding to the number of colors and designs to be printed;

means for spacing the blanket cylinders of said second pair from each other, means for spacing said blanket cylinders of said second pair and said rollers from the corresponding blanket cylinder of the first pair so as to have no printing function;

means for pressing both blanket cylinders of said first pair against each other so as to print an image with superposed colors and designs on both sides of the paper by means of the plurality of said printing plates;

(c) means for selectively adapting said cylinders of one of said groups into selective color inking cylinders of which the relief areas correspond to the portions of the image to be colored in various colors, and of which the number corresponds to the number of colors to be printed, whereas the cylinders of the other group are plate cylinders each provided with a printing plate, the number of said printing plates corresponding to the number of colors and designs to be printed;

means for spacing said blanket cylinders of said first pair from each other wherein the one blanket cylinder contacting the selective color inking cylinders operates as a collecting cylinder;

means for adapting the one of said rollers which is associated with said collecting cylinder with a typographic plate representing the complete design to be printed and set for engagement with said collecting cylinder so as to be inked thereby, means for adapting the other one of said rollers into an image transfer cylinder engaging the other blanket cylinder of the first pair;

means for pressing the blanket cylinders of said second pair against each other so that a juxtaposed color image is printed on one side of the paper by means of said typographic plate inked by the corresponding collecting cylinder and that an image with superposed colors and designs is printed on the other side of the paper by means of the plurality of said printing plates and said image transfer cylinder.

2. Machine according to claim 1, characterized by the fact that for a sheet-fed printing machine there is provided between one of the blanket cylinders of said second pair and the blanket cylinder, located on the same side of the machine, of said first pair, a transfer drum, said three cylinders cooperating with one another in all the modes of operation, and functioning as sheet transfer cylinders, the arrangement being such that in case said blanket cylinder of said second pair transfer the image to the sheet, there is a registration between this image inked on a sheet and the multicolor image present on said blanket cylinder of the first pair when it engages said sheet.

3. The invention in accordance with claim 1 further comprising means for selectively exchanging said groups of several cylinders from selective color inking cylinders to plate cylinders and from plate cylinders to selective color inking cylinders, and means for exchanging each of said rollers from printing plate cylinders to image transfer cylinders and from image transfer cylinders to printing plate cylinders.

* * * * *